US007323627B2

(12) United States Patent
Sweeney

(10) Patent No.: US 7,323,627 B2
(45) Date of Patent: Jan. 29, 2008

(54) SLIP-GRIP

(76) Inventor: James Gerard Sweeney, 14 New London La., Oakmont, PA (US) 15139

( * ) Notice: Subject to any disclaimer, the term of this patent is extended or adjusted under 35 U.S.C. 154(b) by 0 days.

(21) Appl. No.: 11/358,015

(22) Filed: Feb. 21, 2006

(65) Prior Publication Data

US 2007/0193431 A1 Aug. 23, 2007

(51) Int. Cl.
*G10D 3/00* (2006.01)

(52) U.S. Cl. ..... 84/327

(58) Field of Classification Search ..... 84/290, 84/327

See application file for complete search history.

(56) References Cited

U.S. PATENT DOCUMENTS

| | | | | |
|---|---|---|---|---|
| 3,979,993 | A * | 9/1976 | Proctor | 84/327 |
| 6,278,044 | B1 * | 8/2001 | Ruan | 84/279 |
| 2005/0235807 | A1 * | 10/2005 | Kraus | 84/385 P |
| 2006/0174585 | A1 * | 8/2006 | Barr | 52/741.3 |

* cited by examiner

*Primary Examiner*—Kimberly Lockett

(57) ABSTRACT

A permanent, flexible, self-adhesive, non-slip pad, the pad being made of material which can be affixed to the body of a stringed musical instrument to prevent the instrument from slipping in any direction on a player's clothing while the player is in a sitting or standing playing position.

1 Claim, 1 Drawing Sheet

SLIP-GRIP

Slip-Grip: a non-slip, self-adhesive, flexible pad, the pad being made of material which can be affixed to the body of a stringed musical instrument to prevent the instrument from slipping in any direction on the player's clothing while the player is in a sitting or standing playing position.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention is related to a non-slip, self-adhesive, flexible pad, the pad being made of material which can be affixed to the body of a stringed musical instrument where the surface of the instrument comes in contact with the player's clothing.

Because the surfaces of stringed instruments are highly polished there is little friction between the instrument itself and the player's clothing. Therefore, these instruments have a tendency to slip from the player's clothing while being played. The slipping motion of the instrument requires the player to readjust the instrument to the correct playing position, which can be distracting to the player and interfere with his or her performance.

In the case of a guitar being played while in a sitting playing position, many players opt to use a guitar strap to prevent the guitar from slipping from their clothing. This solution can be uncomfortable, confining and cumbersome to the player. Furthermore, a guitar strap is not a suitable solution for many of the other types of stringed instruments that have a tendency to slip from the player's clothing while being played.

This invention addresses the problem of the surface of a stringed instrument slipping on a player's clothing and eliminates the constant readjusting of the instrument, or of the player's position, during the player's performance.

From conducting research of prior art, nothing was found that addresses the problem of a stringed instrument slipping from a player's clothing. However, the search did yield one patent using the phrase, "The cover has anti-slip ribs and may have sheets or patches of frictional material such as cork and rubber or fabric, for example, secured to the back and side of the cover to engage the clothes of the user and prevent slipping relative to the cloths".

In U.S. Pat. No. 3,251,258, dated May 17, 1966, titled "Stringed Instrument Protector", issued to G. H. Parker, there is disclosed a stringed instrument protector which, in one embodied form, comprises a sheet of flexible plastic material, such as polyethylene, to fit closely on the back, sides and a portion of the front of the body of a stringed instrument. This invention is a plastic, protective cover for stringed instruments, namely electric guitars, to protect the instrument's finish from damage while it is on display at the store and while prospective buyers evaluate the instrument. Because this protective cover is made from plastic, Parker found it may be necessary to secure anti-slip ribs made of friction material to the back and sides of the cover to engage the clothes of the prospective buyer and prevent the instrument, while in this protective cover, from slipping on their clothing while being evaluated. This solution does not address the problem of the surface of a stringed instrument slipping on a player's clothing while playing, but is to prevent damage to the instrument while it is on display and while being evaluated by potential buyers. If its intended purpose was to be used on a permanent basis to prevent a stringed instrument from slipping, it would have been a cumbersome solution because the instrument would essentially be enveloped in a plastic glove, which would also adversely affect the acoustic properties of the sound generated by an acoustic, stringed instrument.

BRIEF SUMMARY OF THE INVENTION

The purpose of this invention is to provide a non-slip, self-adhesive, flexible pad, the pad being made of material which can be affixed to the body of a stringed musical instrument, where the surface of the instrument comes in contact with the player's clothing. In the preferred embodiment, the non-slip material has an exposed surface possessing a high coefficient of friction that will prevent the instrument from slipping on clothing. The self-adherent properties of the underside of the material allow it to be affixed to the body of the instrument. A peel-off backing is adhered to the self-adhesive underside of the material to protect the adhesive layer until the pad is affixed to the instrument. The pad can be made in any desired shape and size so as to conform to a wide variety of stringed instrument bodies, such as, but not limited to, banjos, basses, cellos, dulcimers, guitars, harps, lutes, mandolins, sitars, ukuleles, violas and violins.

Because the frictional material can be cut into any shape and size, the non-slip, self-adhesive, flexible pad can be adapted to address the similar problem of slipping in other industry applications where the user of the pad wants to prevent any given product from slipping from his or her clothing, such as, but not limited to, shoulder straps for purses, briefcases, camera bags, luggage, backpacks and golf bags.

DETAILED DESCRIPTION OF THE INVENTION

Figure 1:
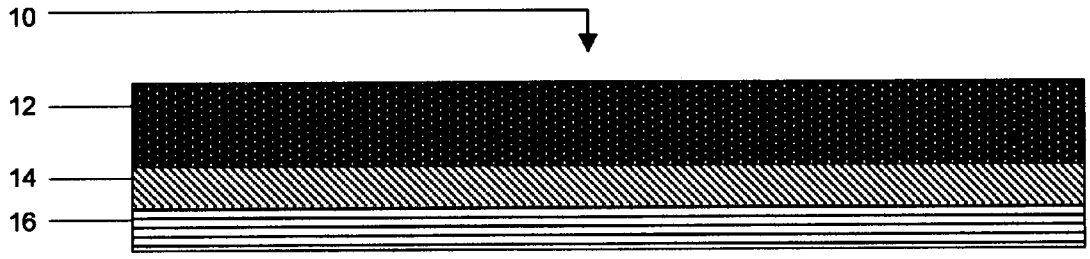
FIG. 1 A cross-section view of the three layers of the material (not to scale) used in the preferred form of the invention, showing the non-slip exposed surface, the self-adhesive underside and the peel-off backing.

Referring now to the drawings, in its preferred embodiment, FIG. 1 shows the invention comprising a non-slip, self-adhesive, flexible pad 10, the pad being die-cut from a sheet of frictional material 12 which has a self-adhesive underside 14 with a peel-off backing 16 that is easily removed, such as, but not limited to, "Self Stick Velvet" or "Rubber Tape with Mastic Adhesive". Both of these products are general usage products found in the arts and crafts supply industry and the industrial electrical industry, respectively. The pad 10 must adhere to the surface of a stringed instrument without adversely affecting the acoustic properties of the sound generated. It may be found that the material's non-slip properties 12 will diminish from use and that the pad 10 must be replaced from time to time. Therefore, the pad's 10 material will utilize an adhesive 14 that holds well but can be easily removed when necessary, without harming the instrument's finish. If there are any remnants of the material's adhesive 14 on the instrument when the pad 10 is removed, the adhesive can be cleaned with a solvent that does not damage the instrument's finish (e.g., rubbing alcohol or naphtha). The pad's 10 material must be capable of deformation to conform to the contour of the instrument and can be made in many shapes and sizes to conform to the specific shape and size of the instrument's body to which it is being applied. Once the peel-off backing 16 is removed and the pad 10 is aligned to the instrument, pressure is applied to the pad 10 to affix it to the instrument's body. Once applied, the pad 10 will remain firmly affixed to the body of the instrument. Removing the pad 10 from the instrument is done by peeling the material away from the instrument's body.

Figure 2:
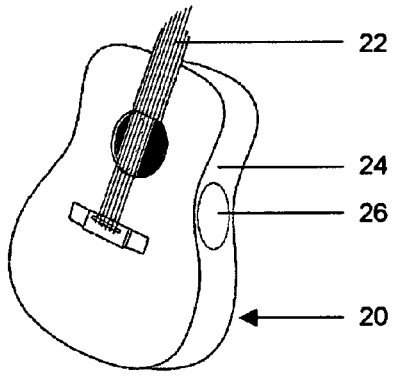
FIG. 2 A perspective view of the non-slip, self-adhesive, flexible pad affixed to the side surface of a dreadnaught acoustic guitar where the guitar comes in contact with the players clothing at the player's thigh. This view also shows how the pad can be made to conform to the shape, size and contour of a specific stringed instrument, in this example a dreadnaught acoustic guitar.

FIG. 2 shows a dreadnaught acoustic guitar 20 which can be played by strumming, plucking or picking the strings 22 while the guitar is rested with its side surface 24 resting against the thigh of the player. The pad 26 of the invention is positioned so that it is approximately centered on the side surface of the guitar where it will meet with the top of the player's thigh.

Figure 3:
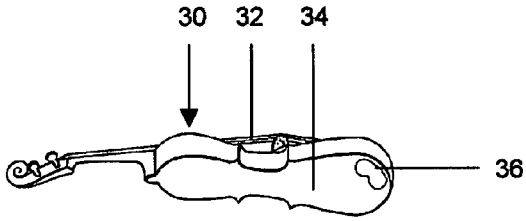
FIG. 3 A perspective view of the non-slip, self-adhesive, flexible pad affixed to the bottom surface of a violin where the violin comes in contact with the player's clothing on the player's shoulder. This view also shows how the pad can be made to conform to the shape, size and contour of a specific stringed instrument, in this example a violin.

FIG. 3 shows a violin 30 which can be played by bowing, plucking or picking the strings 32 while the violin is rested with its bottom surface 34 resting against the shoulder of the player. The pad 36 of the invention is positioned so that it is aligned with the edge of the bottom surface of the violin where it will meet with the top of the player's shoulder.

The shape of the pad 10 is dependant upon the area of the instrument where the pad will come in contact with the player's clothing. If that area is by the edge of the instrument's body, the pad's 10 shape will conform to the contour of the instrument's body.

To determine the specific shape, size and contour of the pad 10, an actual instrument is used to develop a template. The template is developed by placing the instrument in its playing position to establish an outline of the contact area between the instrument and the player's clothing. Once that area is determined, the instrument's shape, size and contour dictates the shape, size and contour of the template. The template is used to manually cut a prototype from the frictional material, which is then affixed to the instrument. Once the prototype is affixed, it is manually trimmed to conform to the exact shape, size and contour of the instrument. Once the prototype is finalized, it is used as a template to make a cutting die. The cutting die is used to mass-produce a commercial product.

Materials and methods of the manufacturer, other than those mentioned above, which will produce an acceptable finished product with the desired characteristics may be used without departing from the scope of the invention.

For example, one part of a hook and loop fastener system can be attached to the body of the stringed instrument and the other part of the hook and loop fastener can be attached to the friction member 12 so that the friction member can be easily and quickly changed without causing potential damage to the instrument or to the friction member. This would be especially useful when a performer wants to change the color or other feature of the friction member in a relatively short time to meet the requirements of his or her performance.

What I claim as my invention is:

1. A permanent, flexible, self-adhesive, non-slip pad for application to the body of a stringed musical instrument where the instrument is positioned against a part of a player's body to steady the instrument and being effective to reduce the tendency of the instrument to slide with respect to a player's clothing; wherein the pad, having a shape, size and contour conforming to the shape, size and contour of the area of contact between the instrument and a player's body, is made from a material having three, flexible, self-conforming layers, namely, an outer friction layer made from a velvet fabric, an intermediate adhesive layer for permanently attaching the friction layer to the body of the instrument, and a peel-off backing layer to protect the adhesive layer until the pad is applied to the instrument.

* * * * *